US005893550A

United States Patent [19]

Lassley

[11] Patent Number: 5,893,550

[45] Date of Patent: Apr. 13, 1999

[54] PORTABLE SNOWBOARD AND SKI FIXTURE

[75] Inventor: Jesse R. Lassley, Salt Lake City, Utah

[73] Assignee: Precision Sports, Inc., Salt Lake City, Utah

[21] Appl. No.: 08/868,455

[22] Filed: Jun. 3, 1997

[51] Int. Cl.[6] ..... B25B 11/00

[52] U.S. Cl. ..... 269/21; 269/88; 269/296; 269/906

[58] Field of Search ..... 269/88, 296, 906, 269/21, 95; 279/3; 451/388; 294/69.1, 65; 248/105.5–206.4

[56] References Cited

U.S. PATENT DOCUMENTS

| | | | |
|---|---|---|---|
| 367,214 | 11/1887 | Bruggeman . | |
| 3,719,008 | 3/1973 | Mayers . | |
| 3,861,664 | 1/1975 | Durkee . | |
| 4,048,700 | 9/1977 | Browne . | |
| 4,050,685 | 9/1977 | Cox . | |
| 4,078,780 | 3/1978 | Schwarz . | |
| 4,081,180 | 3/1978 | Munn | 269/906 |
| 4,175,736 | 11/1979 | Dietlien | 269/906 |
| 4,341,375 | 7/1982 | Romanin | 269/906 |
| 4,382,588 | 5/1983 | Vovk et al. . | |
| 4,669,713 | 6/1987 | Armantrout et al. | 269/906 |
| 5,485,988 | 1/1996 | Nobilec | 269/21 |
| 5,513,837 | 5/1996 | Osborn . | |

*Primary Examiner*—Robert C. Watson

*Attorney, Agent, or Firm*—Chernoff, Vilhauer, McClung & Stenzel, LLP

[57] ABSTRACT

A portable support fixture for snowboards and skis comprises at least two interconnected support portions, with a suction cup secured to the top and bottom of each support portion, and a connecting structure which interconnects the support portions. The connecting structure has an elongate vertical slot which matingly receives and holds a snowboard or ski upright on one of its longitudinal edges for filing and maintaining the edges. The suction cups on the bottom of the support portions may be used to secure the fixture to any relatively flat surface, such as the hood of a car. The top suction cups may be used to secure a snowboard or ski horizontally to the fixture for waxing and maintaining the bottom of the snowboard or ski or for working on the binding(s).

3 Claims, 2 Drawing Sheets

PORTABLE SNOWBOARD AND SKI FIXTURE

BACKGROUND OF THE INVENTION

The present invention relates to a portable support fixture for use in waxing and sharpening snowboards and skis and, in particular, to such a portable fixture which has no moving parts and is relatively simple, lightweight and inexpensive to manufacture and may be used without removing the bindings.

Skis and snowboards are commonly provided with steel edges which must be occasionally sharpened to grip on icy slopes. A bench vise is generally used for holding a ski or snowboard in an edge up position for sharpening the edge. A bench vise is also often used for holding a ski to expose the bottom surface to be waxed, repaired or flat filed. Such vises are expensive, space consuming, and not generally portable. Further, vises are not generally suited for holding snowboards to expose the bottom surface to be waxed, repaired, or flat filed.

In accordance with conventional technology, there are primarily two types of portable fixtures for waxing and sharpening skis. The first type of fixture uses a pair of jaws, at least one movable, as a vise to hold the ski. Examples of such vise fixtures are shown in Romanin U.S. Pat. No. 4,341,375, Durkee U.S. Pat. No. 3,861,664, and Vovk, et al., U.S. Pat. No. 4,382,588. Vise fixtures have a number of movable parts which may be expensive to manufacture, assemble and maintain. Further, while vises may hold skis for both sharpening and waxing, they are generally not well suited to hold snowboards for waxing.

Another type of portable fixture for skis uses spaced support segments and a clamp which holds the skis against the support segments. An example of this type of fixture is shown in Browne U.S. Pat. No. 4,048,700. Such support/clamp devices require at least two supports and a clamp, cannot be used to hold a snowboard, and are virtually useless if the clamp is lost.

Many families and groups travel together to ski sites with both skis and snowboards. Maintaining skis and snowboards is desirable at ski sites or when a skier or snowboarder may wish to work on his skis or snowboard in preparation for the next day's activities. Accordingly, there exists a need for an efficient, inexpensive and versatile support fixture for supporting and positioning both skis and snowboards for sharpening, waxing and maintaining, which support fixture is portable and may be attached to a variety of surfaces for working on skis and snowboards at substantially any location.

SUMMARY OF THE PRESENT INVENTION

The present invention overcomes the foregoing drawbacks of the prior art by providing an improved, inexpensive, compact, portable support fixture, that can be used for maintaining both snowboards and skis and may be attached to a variety of surfaces.

The support fixture includes at least two interconnected support portions with a suction cup secured to the top and bottom of each support portion. A connecting structure interconnecting the support portions has an elongated vertical slot which matingly receives and holds a snowboard or ski upright on one of its longitudinal edges.

The fixture preferably also includes a stabilizing foot on the connecting structure.

Two such fixtures may be spaced apart by affixing the bottom suction cups to a surface, such as the hood of a car, and used to hold a ski or snowboard horizontally on the top suction cups or, alternatively, vertically in the slots.

The support fixture has the advantages of being portable, compact, inexpensive to manufacture and easy to use at a variety of locations. These advantages stem from the fact that the fixture has no movably adjustable parts and yet is versatile enough to support either snowboards or skis in either horizontal or vertical orientations for maintenance purposes.

The foregoing and other objections, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
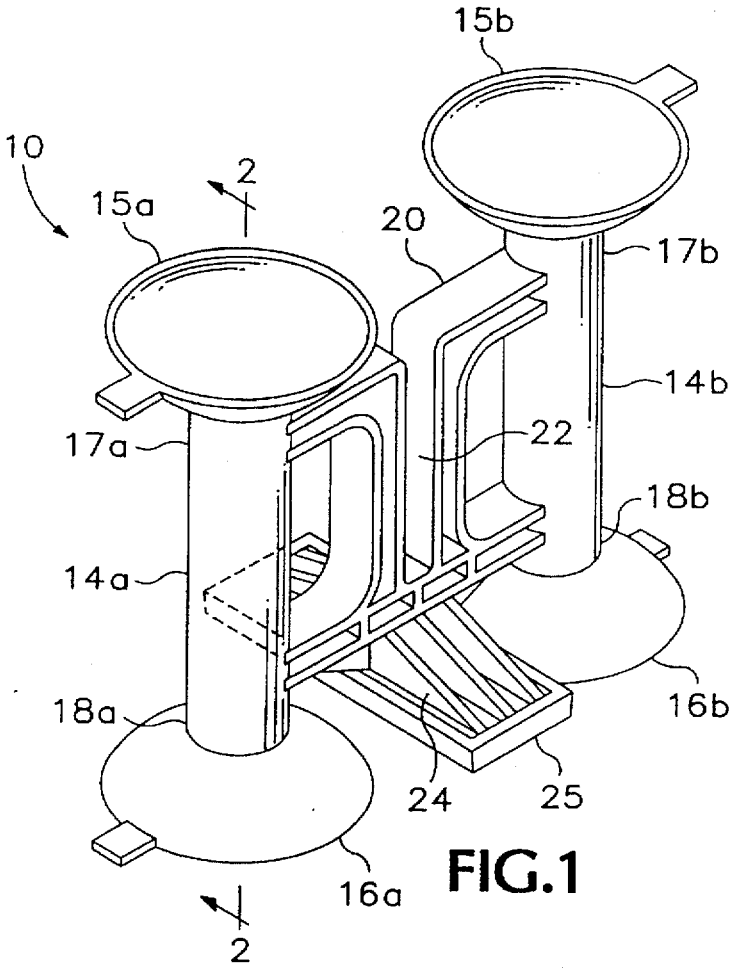
FIG. 1 is a view in perspective depicting an exemplary embodiment of a support fixture in accordance with the present invention.
Figure 2:
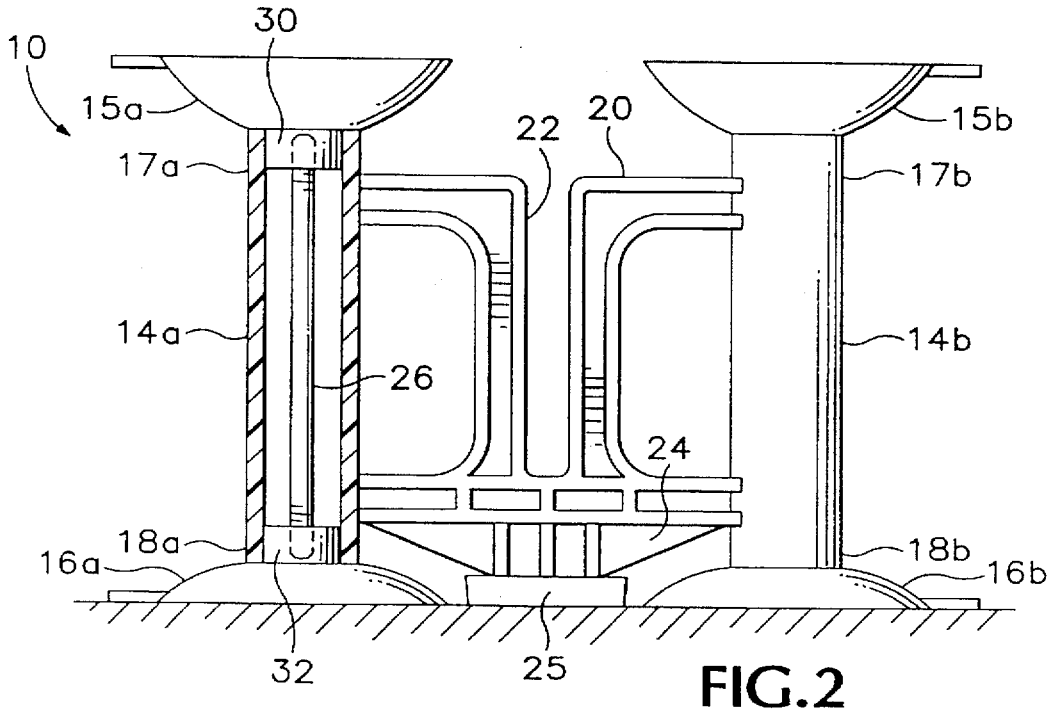
FIG. 2 is a front elevation of the support fixture of FIG. 1, with a cross sectional view of an upright support portion taken along line 2—2 of FIG. 1.
Figure 3:
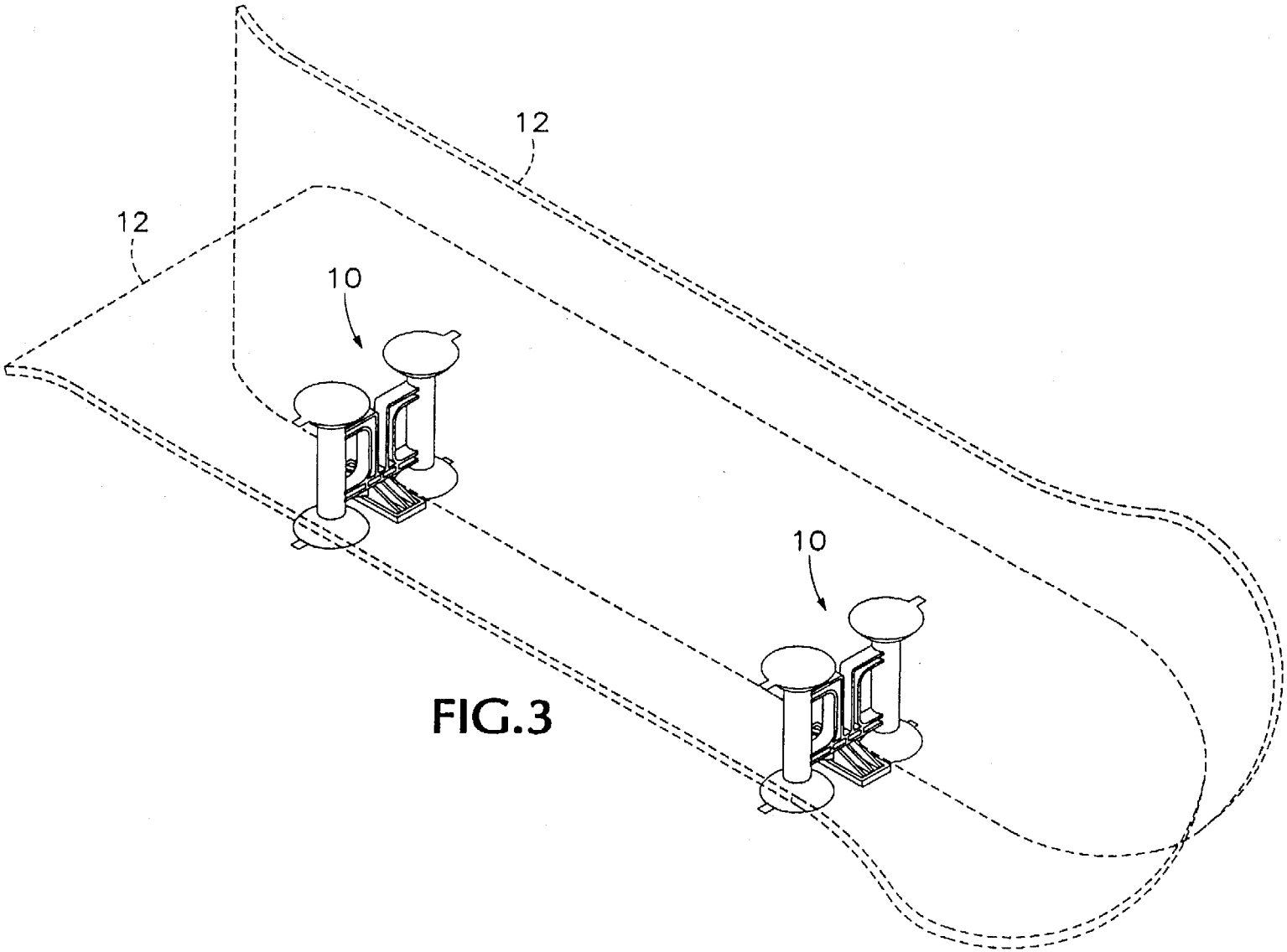
FIG. 3 is an extended view in perspective depicting alternative uses of two support fixtures to support a snowboard on edge and to support a snowboard horizontally.

FIGS. 1 and 2 illustrate a support fixture 10 constructed in accordance with one embodiment of the present invention. The support fixture 10 is adapted to support a ski or snowboard, such as a snowboard indicated generally at 12 in FIG. 3, to facilitate maintenance and servicing of the ski or snowboard without removing the binding or bindings (not shown) therefrom. The support fixture may be used either singularly, or preferably with a second similar support fixture, to support a ski or snowboard in a generally horizontal position, such as shown in FIG. 3, for waxing, repairing or maintaining the bottom surface of the ski or snowboard or for maintaining, repairing or replacing a binding (not shown). Alternatively, the fixture can support a ski or snowboard in a parallel edge up position for sharpening or repairing the edge as shown in FIG. 3.

The support fixture 10 includes at least two interconnected upright support portions 14*a* and 14*b* adapted to secure a respective suction cup 15*a* and 15*b* and 16*a* and 16*b* to each of the top ends 17*a* and 17*b* and to each of the bottom ends 18*a* and 18*b* of the support portions 14*a* and 14*b*. The support portions 14*a* and 14*b* are interconnected by a connecting structure 20, which has an elongate slot 22. The slot defines an opening at its upper end, and is sized to matingly receive a snowboard or ski and hold it firmly upright on its edge perpendicularly to the spacing between the support portions 14*a* and 14*b*. The connecting structure 20 preferably also includes a stabilizing foot 24 extending perpendicular to the spacing between the support portions 14*a* and 14*b*. Preferably a rubberized pad 25 is detachably connected to the bottom of the stabilizing foot 24.

Preferably the support portions 14*a* and 14*b*, the connecting structure 20, and foot 24 are of a monolithic injection molded plastic construction, although they could alternatively be otherwise interconnected.

In the preferred embodiment the support portions 14*a* and 14*b* are defined as elongate upright tubes sized to receive internally threaded bases 30 and 32, respectively, of the suction cups. The suction cups are removably attached to the ends of each support portion by a respective threaded rod 26 located inside the tube and threaded into the bases of the suction cups.

With the bottom suction cups 16*a* and 16*b* attached to a surface such as a car hood or a table, the support fixture 10 may support a snowboard or ski vertically on its edge in the slot 22 for sharpening the edges of the snowboard or ski. FIG. 3 illustrates two support fixtures 10 with their slots 22 aligned such that a snowboard 12 may be held on its edge in the slots. The spacing between the fixtures can be selected so that the slots engage the variable—thickness snowboard or ski at longitudinally-spaced locations where the engagement will be relatively tight. To accomplish this purpose, the width of the slots 22 is preferably within the range between the smallest and largest thicknesses of the snowboard or ski.

Alternatively, the snowboard's upper surface may be secured by the top suction cups of the fixtures for waxing, repairing or maintaining the bottom surface of the snowboard as also shown in FIG. 3. For such use, the two fixtures are positioned so that the top suction cups are aligned horizontally. To support a narrower ski atop all four suction cups, the two fixtures 10 can be oriented at 90° from their orientations of FIG. 3.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A portable fixture for waxing and sharpening snowboards and skis having a pair of longitudinal edges, comprising:

(a) at least two interconnected upright support portions, each of said support portions having a top end and a bottom end;

(b) a plurality of suction cups, one of said suction cups being secured to each said top and said bottom end of each of said support portions;

(c) a connecting structure fixedly interconnecting said support portions at a spaced distance from each other, said connecting structure having an elongated slot with an opening at one longitudinal end of said slot, said slot and opening being oriented and sized to matingly receive a snowboard or ski extending perpendicular to said spaced distance between said support portions and to hold said ski or snowboard upright on one of said longitudinal edges between said support portions;

(d) a stabilizing foot attached to said connecting structure and extending therefrom perpendicular to said spaced distance between said support portions.

2. A portable fixture for waxing and sharpening snowboards and skis having a pair of longitudinal edges, comprising:

(a) at least two interconnected upright support portions, each of said support portions having a top end and a bottom end;

(b) a plurality of suction cups, one of said suction cups being secured to each said top and said bottom end of each of said support portions;

(c) a connecting structure fixedly interconnecting said support portions at a spaced distance from each other, said connecting structure having an elongated slot with an opening at one longitudinal end of said slot, said slot and opening being oriented and sized to matingly receive a snowboard or ski extending perpendicular to said spaced distance between said support portions and to hold said ski or snowboard upright on one of said longitudinal edges between said support portions;

(d) A stabilizing foot attached to said connecting structure and extending therefrom perpendicular to said spaced distance between said support portions;

(e) wherein said support portions, connecting structure and stabilizing foot are monolithically interconnected.

3. A portable fixture for waxing and sharpening snowboards and skis having a pair of longitudinal edges, comprising:

(a) at least two interconnected upright support portions, each of said support portions having a top end and a bottom end;

(b) a plurality of suction cups, one of said suction cups being secured to each said top and said bottom end of each of said support portions;

(c) a connecting structure fixedly interconnecting said support portions at a spaced distance from each other, said connecting structure having an elongated slot with an opening at one longitudinal end of said slot, said slot and opening being oriented and sized to matingly receive a snowboard or ski extending perpendicular to said spaced distance between said support portions and to hold said ski or snowboard upright on one of said longitudinal edges between said support portions;

(d) wherein said support portions comprise elongate upright tubes to which said suction cups are removably secured.

* * * * *